US005533254A

United States Patent [19]

Gallo et al.

[11] Patent Number: 5,533,254

[45] Date of Patent: Jul. 9, 1996

[54] TOOL FOR APPLYING WEDGE TYPE ELECTRICAL CONNECTORS TO THE CONDUCTORS OF ELECTRICAL DISTRIBUTION NETWORKS

[75] Inventors: Esdras Gallo; Milton E. Diniz, both of Braganca, Brazil

[73] Assignee: The Whitaker Corporation, Wilmington, Del.

[21] Appl. No.: 513,164

[22] Filed: Aug. 9, 1995

Related U.S. Application Data

[63] Continuation of Ser. No. 286,564, Aug. 5, 1994, abandoned.

[30] Foreign Application Priority Data

Aug. 13, 1993 [BR] Brazil ..... 9303375

[51] Int. Cl.[6] ..... H01R 43/26; B25C 1/10; B21F 15/06

[52] U.S. Cl. ..... 29/750; 29/254; 29/758; 140/113; 227/10

[58] Field of Search ..... 29/33 M, 254, 29/255, 748, 750, 751, 758; 60/632, 636; 7/107; 140/113; 227/9, 10

[56] References Cited

U.S. PATENT DOCUMENTS

| | | | |
|---|---|---|---|
| 2,003,843 | 6/1935 | Temple, Jr. | 29/254 X |
| 2,213,435 | 9/1940 | Temple, Jr. | 227/9 |
| 3,212,534 | 10/1965 | Broske | 29/254 X |
| 3,257,499 | 6/1966 | Broske | 29/254 X |
| 3,292,665 | 12/1966 | Broske | 140/113 |
| 3,458,996 | 8/1969 | Mixon, Jr. et al. | 227/10 X |

FOREIGN PATENT DOCUMENTS

| | | | |
|---|---|---|---|
| 466226 | 6/1950 | Canada | 29/254 |

*Primary Examiner*—Peter Vo
*Attorney, Agent, or Firm*—Timothy J. Aberle

[57] ABSTRACT

The present invention relates to a tool (1) for application of wedge type electrical connectors (2) to conductors (3) of electrical distribution networks. The tool (1) is fired by a powder charge loaded in commercial metallic cartridges 22 caliber which are loaded with different types of powder charge for the proper application of different sizes of wedge type connectors which can be applied by the tool (1) of the present application.

The tool (1) for application of connectors (2) of the present invention is basically comprised of two pieces (7,8). One of the pieces being an elongated body called a coupling (7) and the other one a front piece (8) comprised of a coupling cover (9) and a firing cover (10).

The tool (1) of the present invention further is provided with a mechanical device (13), that is a lock device, positioned in the frontal portion of the coupling (7) of the tool (1). The mechanical device (18) holds the ram (11) pressed against the applied connector after firing a cartridge (4).

11 Claims, 6 Drawing Sheets

TOOL FOR APPLYING WEDGE TYPE ELECTRICAL CONNECTORS TO THE CONDUCTORS OF ELECTRICAL DISTRIBUTION NETWORKS

This application is a continuation of application Ser. No. 08/286,564 filed Aug. 5, 1994, now abandoned.

FIELD OF THE INVENTION

The present invention relates to tools for application of connectors of the wedge type used in electrical distribution networks. More the present invention relates to a tool for application of electrical connectors of the wedge type to conductors of electrical distribution networks, which is fired by the expansion of gases of a powder charge loaded in a commercial metallic cartridge of 22 caliber.

BACKGROUND OF THE INVENTION

In the art of application of electrical connectors to conductors of electrical distribution networks desirable that the connectors be applied to conductors in a way that a safe connection be effected without using heavy or complicated application tools or tools which require a separate power unit such as, for example, pneumatic/hydraulic Consequently, tools for application of electrical connectors to conductors of electrical distribution networks of the type which are fired by the expansion of gases of a powder charge are well accepted since the tools are compact, light, of low cost of operation, and do not require a power unit, which permits their use in places where conventional power units are not available.

However, the tools for application of wedge type electrical connectors to conductors of electrical distribution networks which are fired by the expansion of gases of a powder charge of the prior art, present the disadvantage of using only specific cartridges. Thus, it is not possible to employ in such cartridges of conventional gas expansion which are available in the market.

Further, the tools for application of connectors, of the prior art, present the disadvantage of being heavy.

Therefore, it is desirable for the development of a tool for application of electrical connectors to conductors of electrical distribution networks, of the type fired by the expansion of gases of a powder charge, which even if fired accidentally does not offer any danger to the user, and further which uses metallic cartridge of the type available commercially, thus, overcoming the disadvantage presented by the tools for application of electrical connectors of the prior art.

SUMMARY OF THE INVENTION

The present invention discloses a tool for application of electrical connectors, of the wedge type, to conductors of electrical distribution network, which is fired by expanding gases of a powder charge, and employs commercial metallic cartridge of 22 caliber.

The tool for application of electrical connectors of the present invention is basically comprised of an elongated body called a coupling, a coupling cover of the cartridge and a firing cover of the firing device.

Further, the tool of the present invention presents a mechanical device, that is a lock device, positioned at the front part of the coupling of the tool, which functions to hold the ram of the tool firmly engaged with the assembled connector, thus avoiding having the tool separate itself from the connector and fall down from the supporting post of conductors of the electrical distribution network.

BRIEF DESCRIPTION OF THE DRAWINGS

Embodiments of the present invention will now be described by way of example with reference to the accompanying drawings in which:

FIG. 3 is a longitudinal sectional view of the application tool for electrical connectors of the present invention, showing all constructive elements of said tool;

DETAILED DESCRIPTION OF THE PREFERRED EMBODIMENT

Figure 1:
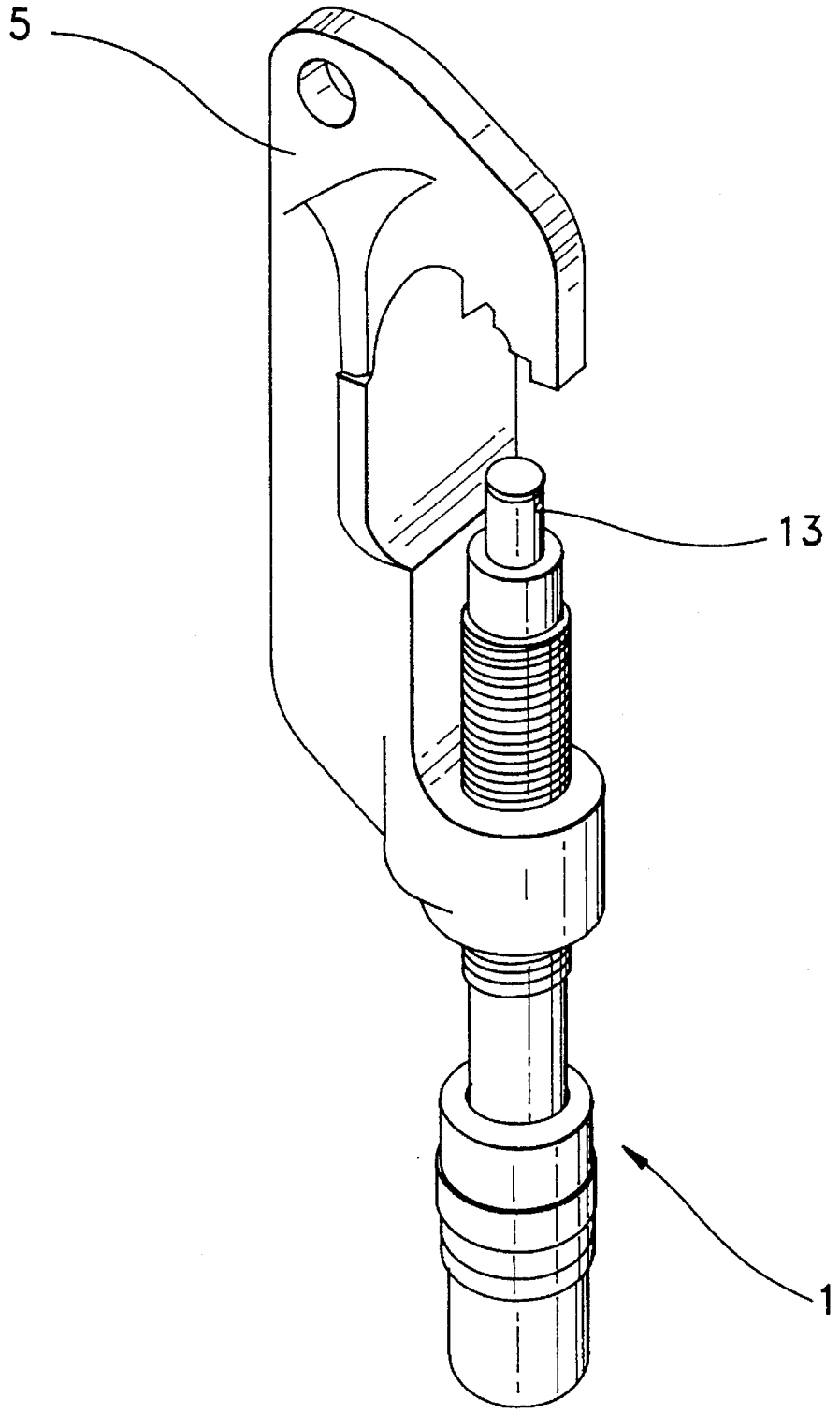
FIG. 1 is a perspective view showing the application tool for electrical connectors of the present invention coupled to a base, or tool head, for supporting the connectors.
Figure 2:
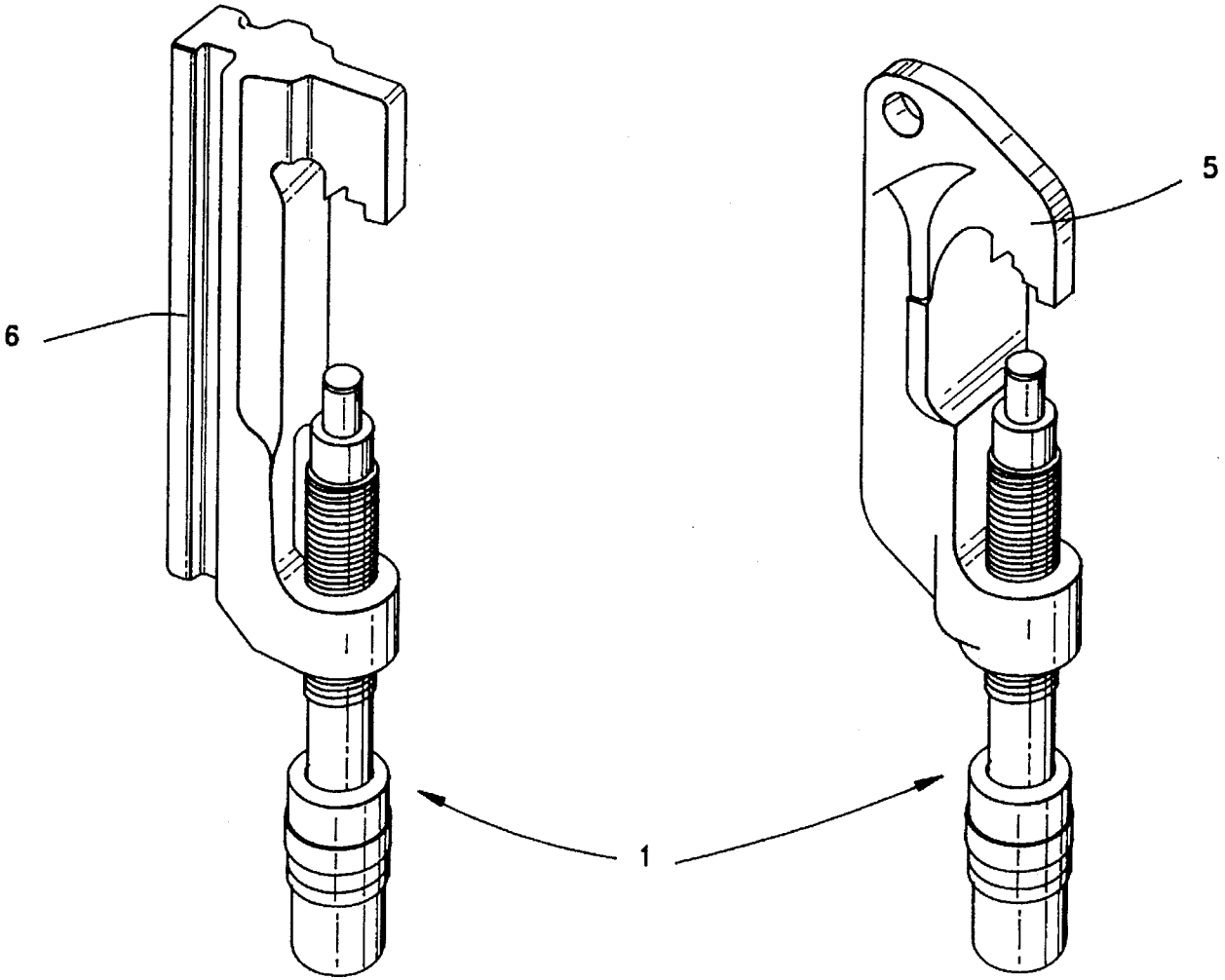
FIG. 2 is a perspective view showing the application tools for electrical connectors of the present invention coupled to bases or tool heads used in the prior art, for supporting the connectors, which permits the desirable interchangeability of the prior and the new art.
Figure 7:
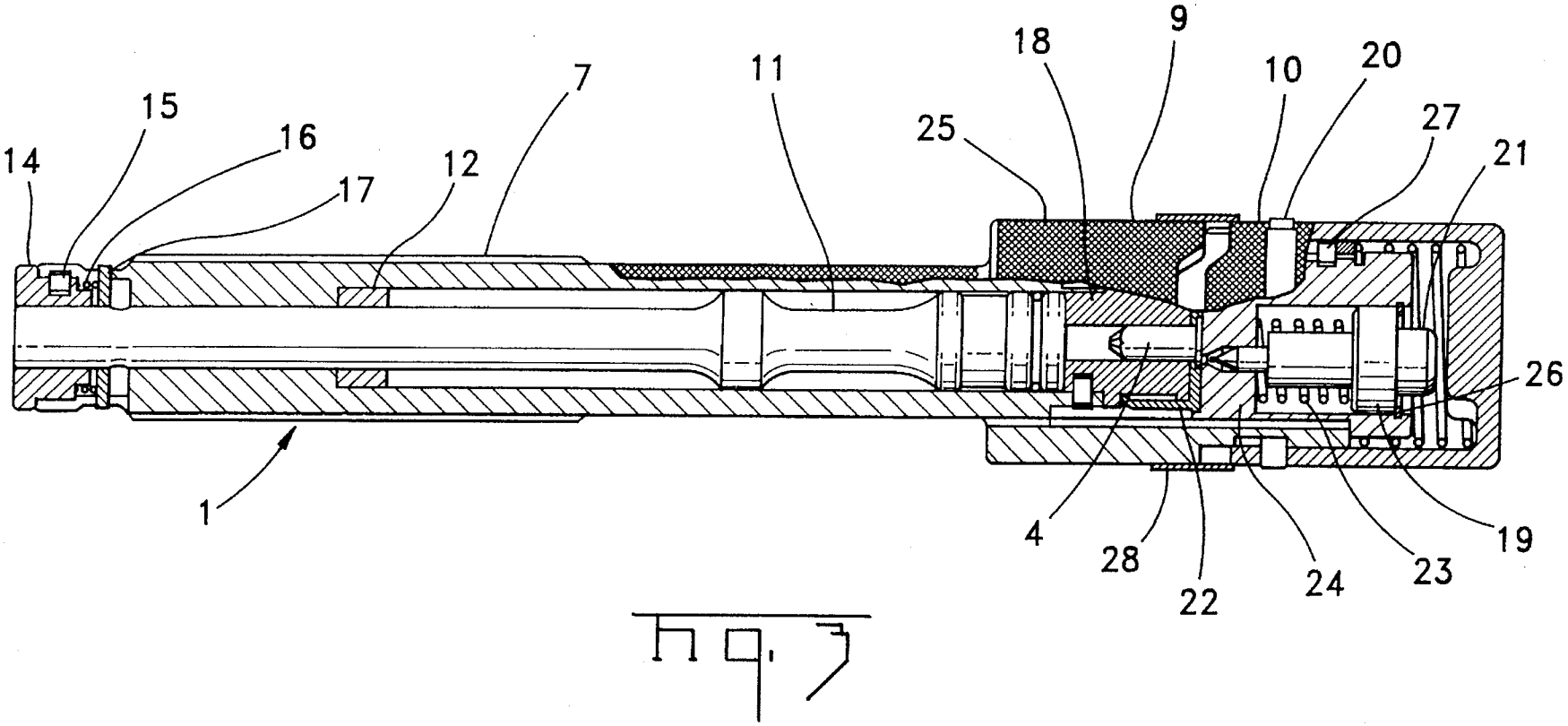
FIG. 7 is a perspective view, showing the removal of the fired tool of present invention after being used for application of electrical connectors to conductors of electrical distribution networks.
Figure 4:
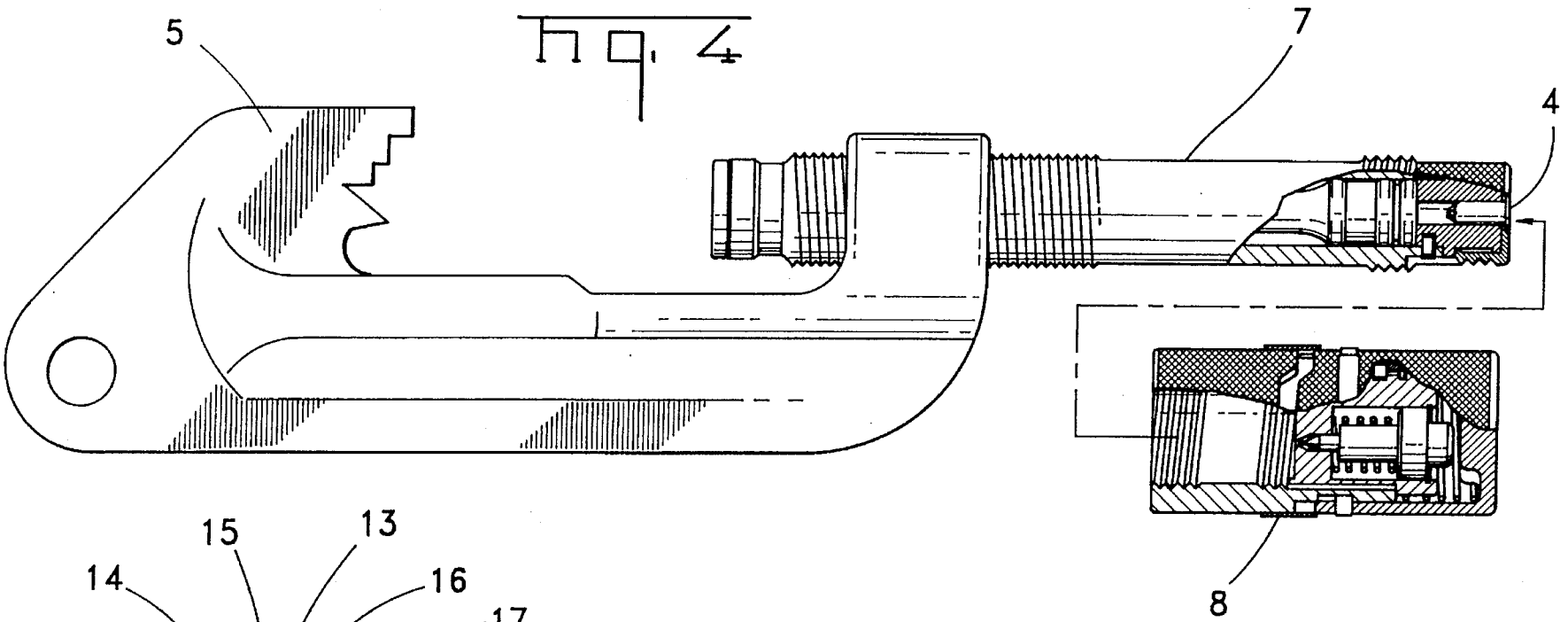
FIG. 4 is a partial sectional view of the portions comprising the tool for application of connectors coupled to a support base or tool head of the connector.

The tool 1 for application of electrical connectors 2 to conductors 3 of electrical distribution networks of the present invention is of the type fired by the expansion of gases of a powder charge, and employs commercial metallic cartridges 4 preferably of 22 caliber.

The tool 1 for application of electrical connectors 2 is manufactured in such a way that it can be used in both existing small-head 5 and large-head 6 tools, and it is basically comprised of two pieces, an elongated body defining a coupling 7, and a firing mechanism 8 composed of a coupling cover 9 and a firing cover 10.

The coupling 7 is a substantially cylindrical elongated body having a ram 11 which moves inside the coupling 7. The coupling 7 further is provided with an aluminum crush sleeve 12 surrounding the ram 11. If the tool 1 for application of connectors 2 is fired without a connector 2 in the head tool 5, the aluminum crush sleeve 12 surrounding the ram 11 will be crushed thus avoiding damage to the ram body 11 and the coupling.

Figure 5:
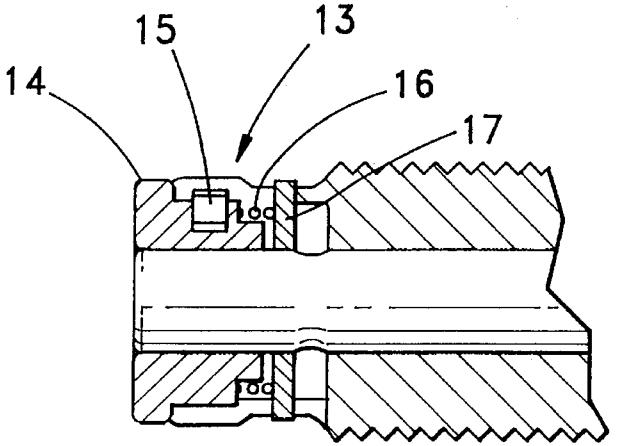
FIG. 5 is a sectional view of a mechanical device which operates as a lock to hold the ram pressed against the applied connector after the firing of the cartridge.
Figure 6:
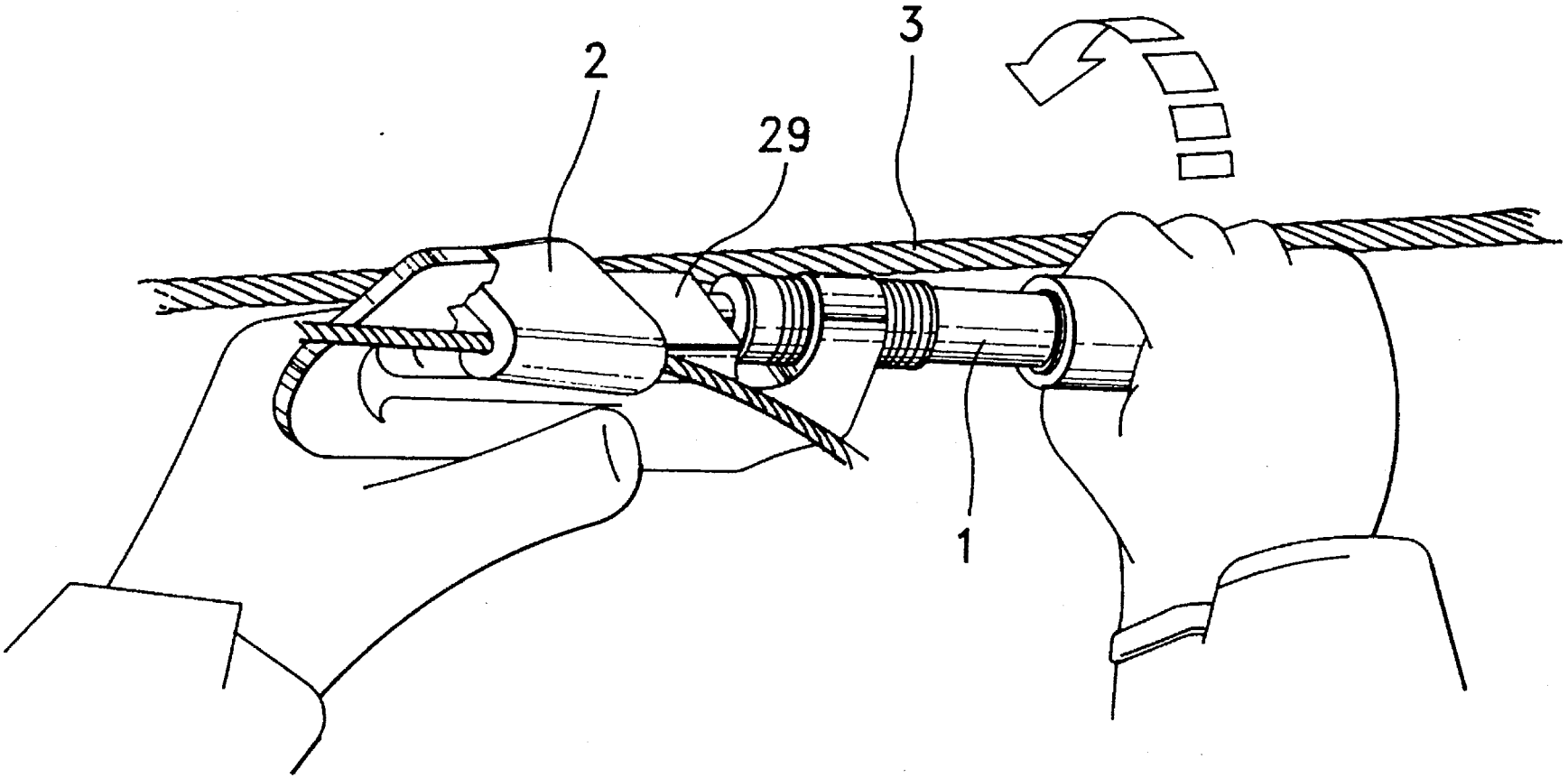
FIG. 6 is a perspective view showing the tool of the present invention being used for application of electrical connectors to conductors of electrical distribution networks.
Figure 7:
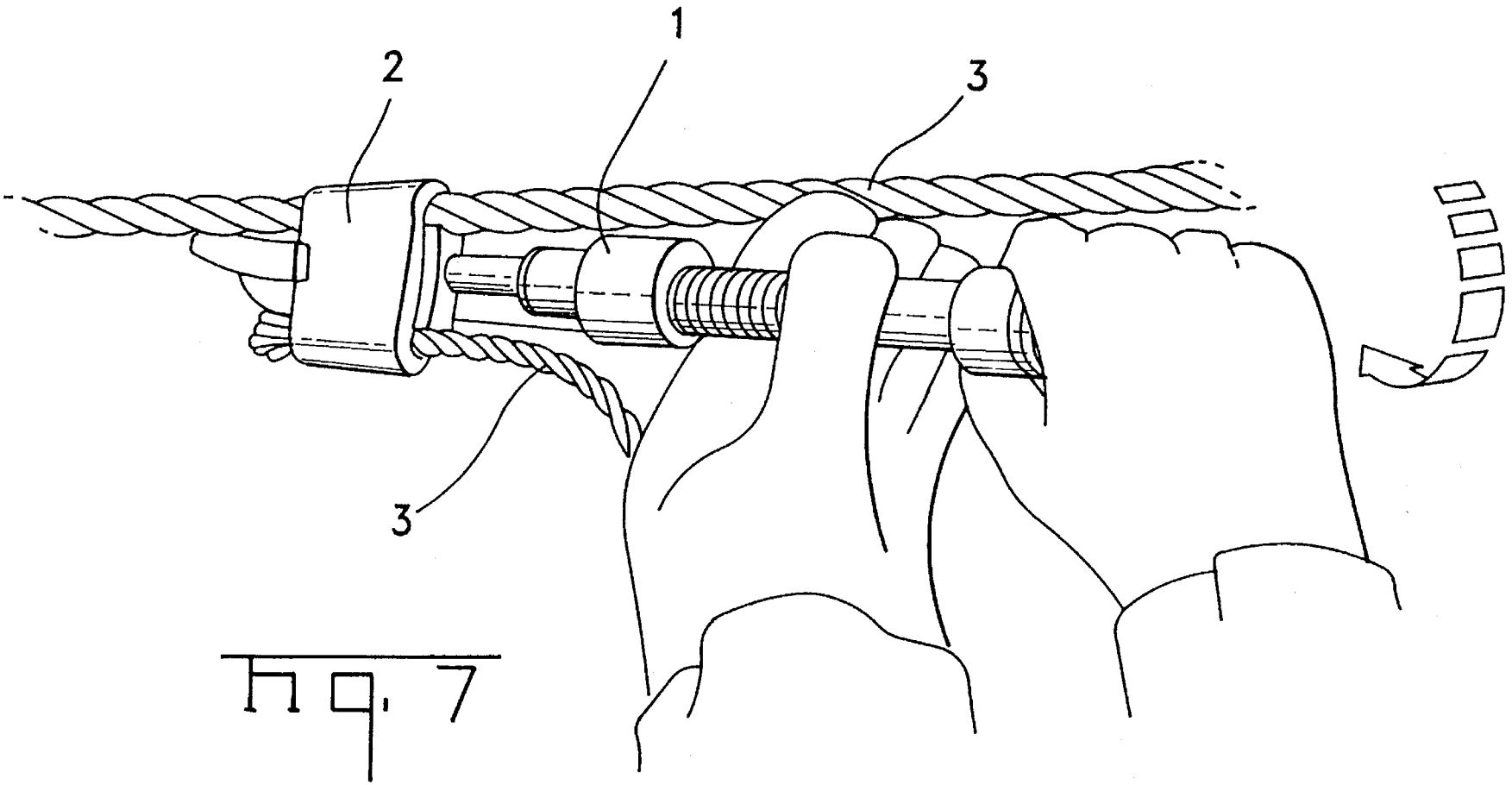

The coupling 7 is also provided at its frontal end, with a mechanical device 13 which operates as a lock that assures that the ram 11 is firmly engaging with the applied connector after the firing of the cartridge. The mechanical device 13, best shown in FIG. 5, is comprised of a cover 14, a set screw 15, a spring 16 and a washer 17. After firing, the tool 1 vents the gas automatically out the front of the tool at the end of the coupling 7 where the lock device 17 is installed, as described above, that assures that the ram 11 is firmly engaged with the assembled connector. Also, in order to release and retract the ram 11, the washer needs to be pushed against the spring using only a finger tip.

The cartridge coupling cover 9 of tool 1 has a cylindrical shape and it is comprised of screw threads to be threadably coupled to the coupling 7. Coupling 7 additionally has in its inner portion a cartridge housing 18 whose function is to house cartridge 4 before the firing of the tool 12 by a firing pin 19 housed in the coupling cover 9 which, in its turn, ignites the charge of cartridge 4.

A firing positioner 10 is coupled to the cartridge coupling cover 9 by means of a positioner ring 20. The positioner ring 20 places the firing cover 10 for application of connectors 2 by turning counter-clockwise about 60 degrees for firing the tool. Additionally, the firing cover 10 has a spring 21 which is used to remove automatically the firing cover 10 from its firing position to the initial safe position after firing the tool 1. A retaining ring 26 secures the firing pin 19 in the firing pin housing 24. A set screw 27 extends between firing cover 10 and firing pin housing 24.

After firing, the firing mechanism 8 is moved relative to coupling 7 by a pull and push movement of sleeve ejector 22 to eject cartridge 4 from the tool 1.

The firing pin housing 24 has a spring 23 lodged therein which is used to assure that the firing pin 19 is retracted in the firing pin housing 24 before operation.

There is a sealing ring 25 between coupling 7 and the cartridge housing 18 which operates as a gas sealing device when the tool 1 is fired.

The operation of the tool 1 for application of connectors 2 is very simple and lies in the positioning of a commercially available cartridge 4 in the cartridge housing 18 and then coupling the firing mechanism 8 to coupling 7. After being coupled, the firing cover 10 is turned counter-clockwise about 60 degrees in order that firing pin 19 is positioned in a non central point and is able to cause the occurrence of the cartridge percussion.

After the coupling 7 and the firing mechanism 8 are firmly coupled together, it is necessary to strike the back end of firing mechanism 8 solidly with a hammer of sufficient weight or another tool (not shown in the drawings) in order to cause an impact of the firing pin 19 against the cartridge head 4 which ignites the charge. Thus, expanding gases force the ram 11 forward and forces wedge 29 into connector 2. After firing, lock device 13 located at the front portion of coupling 7 assures that the ram 11 is firmly engaged with the wedge 29. In order to release and retract the ram 11, a simultaneously backward movement of the ram 11 and a forward movement of the washer 17 is needed. The ram 11 is then maintained fully retracted and ready for the next operation.

Accordingly, tool 1 of the present invention applies electrical connectors 2 to conductors of electrical distribution networks employing commercial metallic cartridges which are loaded with specific powder charge for the proper application of different sizes of wedge type connectors which are applied by tool 1 of the present invention.

Although the invention has been shown and described with respect to a best mode embodiment thereof, it should be understood by those skilled in the art that the foregoing and various other changes, omissions and additions in the form and detail thereof may be made therein without departing from the spirit and scope of the invention as claimed in the appended claims.

We claim:

1. A tool for applying a wedge into an electrical connector, wherein the tool is fired by an expansion of gases from the detonation of a powder charge by a firing pin, the tool comprising:

an elongated, hollow body of a substantially cylindrical shape having a ram movably disposed to first and second positions, said second position comprising an outer operated position exterior of said elongated member;

a mechanical device provided on a front end of said elongated body which includes a spring biased member holding the ram at said second outer operated position after the wedge has been driven into the electrical connector by the detonation of said powder charge by said firing pin; and said mechanical device comprises a cover, and a spring disposed adjacent to said cover.

2. The tool of claim 1, wherein said spring biased member comprises a washer.

3. The tool of claim 2, wherein said ram is disposed in said washer and said ram is released by pushing said washer towards said spring.

4. A tool for applying a wedge into an electrical connector, wherein the tool is fired by an expansion of gases from the detonation of a powder charge by a firing pin, said tool comprises:

a hollow body having a ram member movably disposed within said body, said ram member is displaceable from a first position to a second position and back to said first position relative to said body;

a mechanical locking device mounted on an end of said body, said mechanical locking device comprises a locking washer which is operable to frictionally engage a portion of said ram, thereby locking said ram against further displacement in said second position; and said ram is disposed through said washer and the ram is released by pushing said washer towards a spring of said mechanical locking device.

5. The tool of claim 4, wherein said ram projects relatively outwardly from said mechanical locking device when said ram is in the second position.

6. A tool for applying a wedge into an electrical connector, wherein the tool is fired by an expansion of gases from the detonation of a powder charge by a firing pin, said tool comprising:

a hollow body having a ram member movably disposed within said body, said ram member is displaceable from a first position to a second position and back to said first position relative to said body; and a mechanical locking device mounted on said body, said mechanical locking device comprises a releasable locking member;

said releasable locking member is movable relative to said body and is not part of said body, and the locking member is thereby operable to frictionally engage a portion of said ram, thereby positively retaining said ram against further displacement in said second position until said releasable locking member is released.

7. The tool of claim 6, wherein said releasable locking member comprises a locking washer.

8. The tool of claim 7, wherein said ram is released by pushing said washer towards a spring of said mechanical locking device.

9. The tool of claim 7, wherein said ram is disposed through said washer.

10. The tool of claim 6, wherein said mechanical locking device comprises a cover which is attached to said ram by a set screw.

11. The tool of claim 6, wherein said mechanical locking device comprises a spring for biasing said releasable locking member.

* * * * *